US005945017A

United States Patent [19]

Cheng et al.

[11] Patent Number: 5,945,017

[45] Date of Patent: Aug. 31, 1999

[54] FIRE SAFETY DEVICE FOR STOVE-TOP BURNER

[76] Inventors: Yu-tarng Cheng; Lily I Cheng, both of 13537 Scottish Autumn La., Darnestown, Md. 20878-3990

[21] Appl. No.: 08/906,983

[22] Filed: Aug. 6, 1997

[51] Int. Cl.[6] ..... H05B 3/68; H05B 1/02

[52] U.S. Cl. ..... 219/446.1; 219/518

[58] Field of Search ..... 219/448, 449, 219/451, 452, 453, 509, 510, 518

[56] References Cited

U.S. PATENT DOCUMENTS

| | | | |
|---|---|---|---|
| 2,813,962 | 11/1957 | Skala | 169/26 |
| 4,483,314 | 11/1984 | Parker, Jr. et al. | 126/221 |
| 4,499,368 | 2/1985 | Payne | 219/452 |
| 4,577,181 | 3/1986 | Lipscher et al. | 126/42 |
| 4,587,406 | 5/1986 | Andre | 219/450 |
| 4,692,596 | 9/1987 | Payne | 219/450 |
| 4,714,822 | 12/1987 | Braun et al. | 219/449 |
| 4,775,913 | 10/1988 | Ekblad | 219/518 |
| 5,294,779 | 3/1994 | Miquelot | 219/518 |
| 5,380,985 | 1/1995 | Graham | 219/452 |
| 5,490,566 | 2/1996 | Purser | 169/26 |
| 5,717,188 | 2/1998 | Vaillancourt | 219/452 |

*Primary Examiner*—Philip H. Leung
*Assistant Examiner*—Sam Paik

[57] ABSTRACT

Most residential fires originated in the kitchen areas and were the results of negligence during cooking. As the least regulated cooking appliance in a kitchen, stove-top burners were often the culprits. Burners were left on without user presence and caused utensil melt down, igniting fire. It is the objective of this invention to minimize such risks. An electric or gas burner can be improved by the installation of an automated fire safety device that first determines whether the burner is being attended to and if not, senses the temperature of the cooking utensil on it and automatically shuts off the flow of electricity or gas to the burner when the temperature of the cooking utensil begins to exceed a predetermined temperature range.

A motion detector is integrated into the safety device and serves as the front-end to a temperature sensor switch. The switch is designed to trigger a power shut-off mechanism when high utensil temperature is encountered. The mechanism will be deactivated if motion is detected within a set periphery of the stove appliance. It will automatically be reactivated a set time later after no motion is detected. This invention will not interfere with normal cooking procedures while drastically reducing the possibility of kitchen fires due to cooking.

5 Claims, 3 Drawing Sheets

Flow Chart of a Fire Safety Device for Stove-top Burner

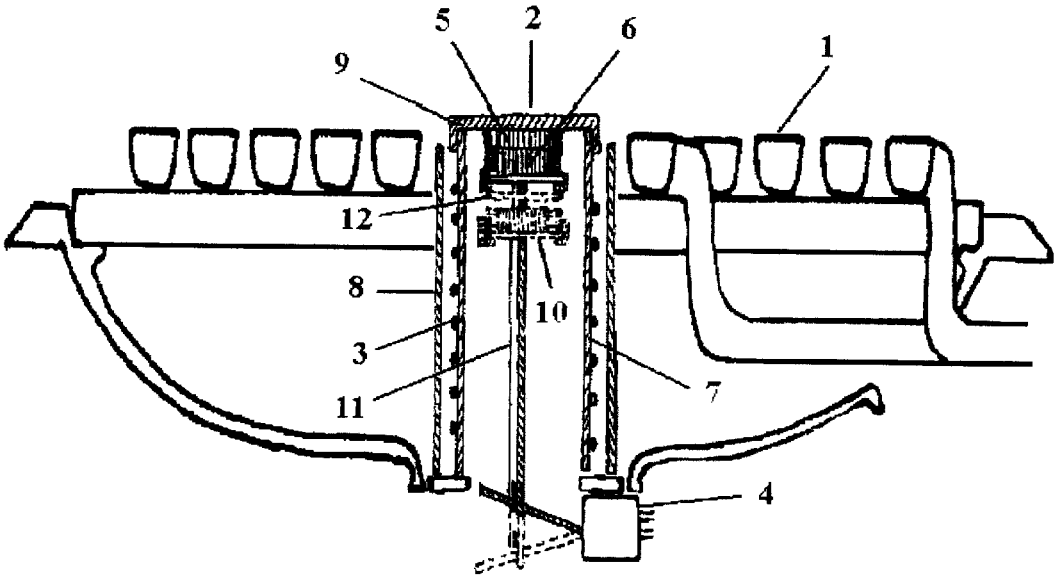
Figure 1. Cross-section View of a Temperature Sensor Switch for an Automated Fire Safety Device for Stove-top Burner.

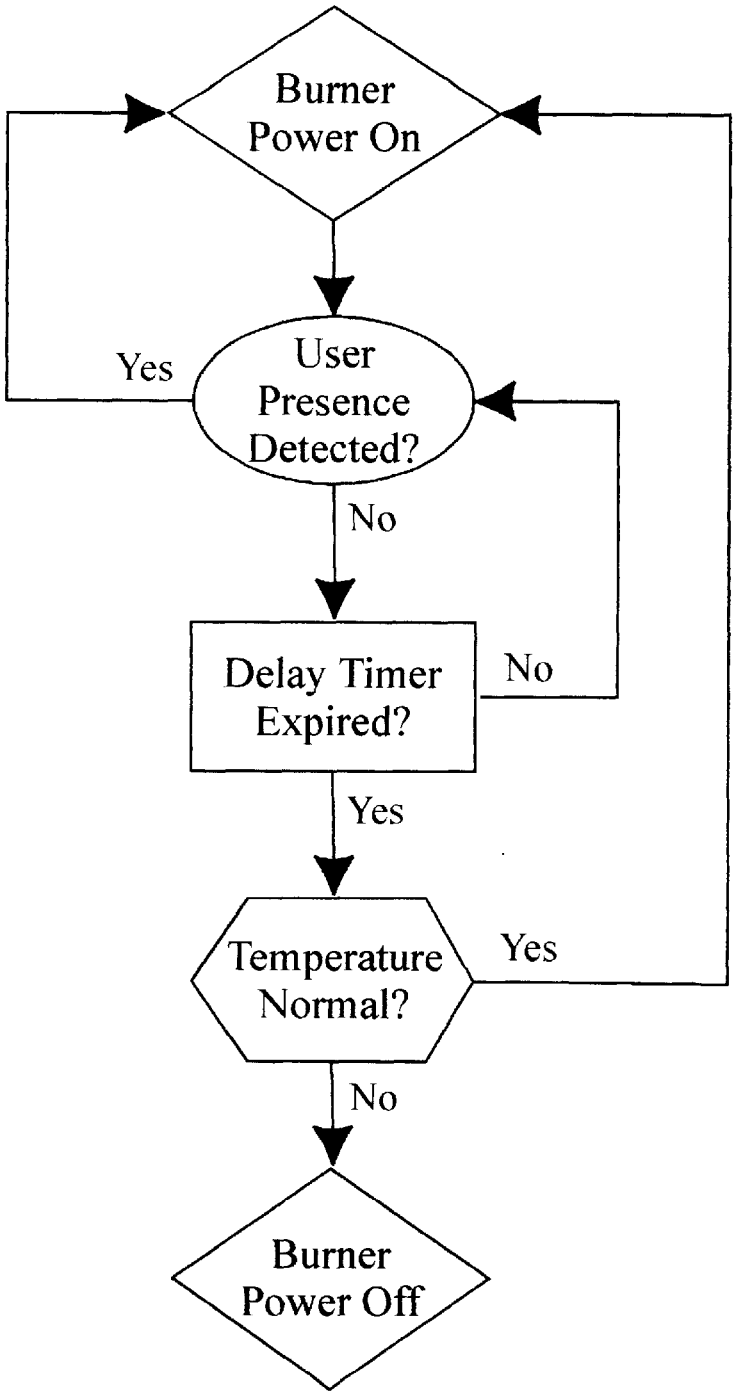
Figure 2. Flow Chart of a Fire Safety Device for Stove-top Burner

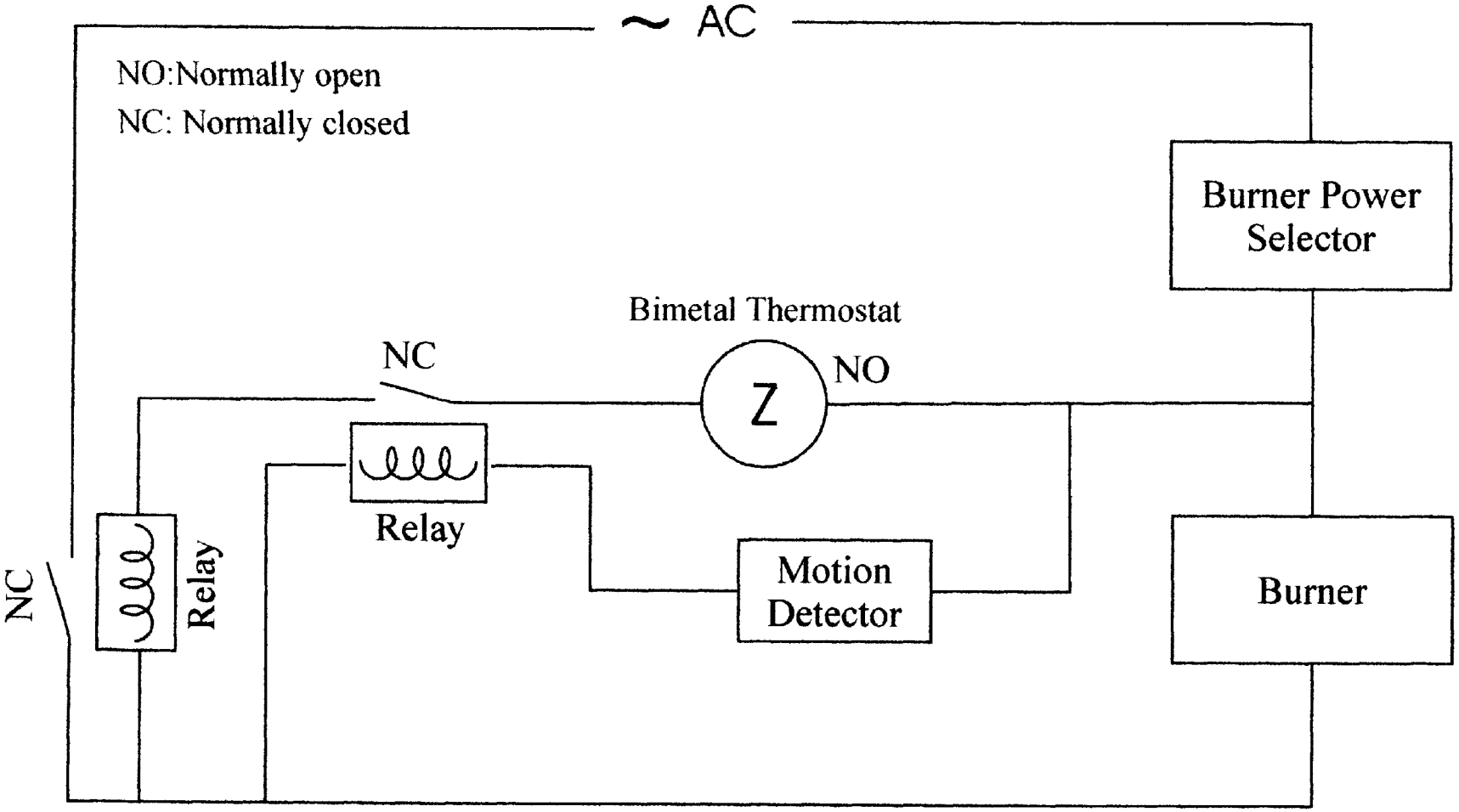
Figure 3. Block Diagram of an Automated Fire Safety Device For Stove-top Burner

FIRE SAFETY DEVICE FOR STOVE-TOP BURNER

BACKGROUND OF THE INVENTION

Statistics obtained from the Fire Marshall Office of the State of Maryland show that kitchens are the most frequent areas of residential fire origin. Of the kitchen fires reported in 1996, close to 75% of them were accidents from cooking. All cooking appliances other than stove-top burners in the kitchen are governed either by temperature or time or both. This exception has made the stove-top burners a major fire hazard in a residential kitchen. Many fires are initiated there due to negligence wherein a burner is accidently left on with food in a utensil. The content of the utensil eventually ignites when the dried food is held at cooking temperatures for a prolonged period after all liquids have evaporated.

Efforts have been made in the past to address this issue. Examples of some recently patented safety devices designed for stove-top burners are: 1. a switch that allows a burner to be turned on only when there is a utensil placed on it (U.S. Pat. No. 4,577,181); 2. a motion detector installed in the stove appliance that automatically reduces or turns off power to the stove if no movement is detected in the proximity within a predetermined length of time (U.S. Pat. Nos. 4,775,913; 5,717,188; 5,380,985); 3. an automated fire extinguisher installed above a stove (U.S. Pat. No. 4,483,314; 5,490,566 and others); and 4. a combination sensor installed in the center of an electric hotplate that senses the presence of a utensil, measures its temperature and cuts off electrical supply to the hotplate when temperature reaches a predetermined value (U.S. Pat. No. 5,294,779). These designs each only address part of the problem and do not provide a complete solution. For example, design 1 will not prevent overheating conditions and design 2 cannot be used in the user's absence for prolonged boiling or steaming of food. Design 3 requires extensive modification around the stove area and may be falsely triggered in some cooking processes using high heat, such as frying. Regarding the aspect of providing a positive power shut-off when a critical utensil temperature is reached in cooking, this invention shares the same objective as design 4. However, a senor switch with a fixed temperature threshold as suggested by design 4 cannot be used in all cooking situations. When used in high heat applications, such as during frying, the hotplate could be turned off prematurely.

Other efforts in the U.S. and elsewhere to regulate the stove-tops include the controlling of burner settings or on-off cycles according to the temperature of the cooking utensil placed on it (U.S. Pat. Nos. 4,499,368; 4,587,406; 4,692,596; 4,714,822 and others). Temperature sensitive switches are either incorporated directly into stove-top burners or attached to utensils to regulate burner power. Some designs include both a timer and temperature control. They provide some amount of safety measure in that either temperature or time is controlled during the cooking period. They, however, do not eliminate fire hazards. In some overheating conditions, power could still be cyclically supplied to the burner. One of the designs uses microprocessor control and the rate of utensil temperature change information to prevent boil-dry conditions under special usage settings or a burner from being energized while unoccupied. These efforts all involve costly and elaborate designs to automate certain cooking processes and not to address any specific fire safety issues. Furthermore, complicated usage instructions limit their acceptance.

Accordingly, it is an object of this invention to provide stove-top burners with a higher standard of safety that will dramatically reduce the chance of kitchen fires due to cooking.

BRIEF SUMMARY OF THE INVENTION

The use of stove-top burners is a common cause for kitchen fire. The risks are significantly higher in unattended or forgotten cooking situations. Past efforts to add fire safety measures to burners have all come short in addressing this concern adequately or they require user input before any safety measure can be activated. This invention will drastically reduce the fire risk in unattended or forgotten cooking situations by using a temperature sensor switch that senses an abnormal overheating condition and positively shuts off power to the burner unit. This sensor switch is further regulated by a motion detector which senses the presence of the user and deactivates the sensor switch to give the user full control of the burner. The function of the sensor switch will be restored automatically if the user is not present and if a predetermined delay time has elapsed. This fire safety device will perform non-intrusively and only as necessary. It consists of three low cost components: a temperature sensor switch, a motion detector and a solenoid. For gas burner applications a solenoid valve is integrated with the sensor switch. The device can be incorporated by manufacturers directly into a new burner apparatus without changing its appearance or operating procedures. This device can also be retrofitted to existing burners with minimum disassembling.

BRIEF DESCRIPTION OF THE DRAWINGS

FIG. 1 is the cross-section view of a ceramic magnet temperature sensor switch for a stove-top fire safety device installed in a electric burner.

FIG. 2 is a flow chart of the concept of a stove-top fire safety device.

FIG. 3 is a block diagram of an automated fire safety device for a stove-top burner.

DETAILED DESCRIPTION OF THE INVENTION

This invention relates to an improvement of the conventional stove-top burner by adding a safety device which automatically shuts off the flow of electricity or gas to the burner when the temperature of the utensil on it exceeds a set temperature range. Furthermore, the safety device is regulated by a motion detector that senses user presence to determine whether or not to bypass the power shut-off mechanism. If no movement is detected within a predetermined period, the safety device is automatically reactivated. This allows full control of burner operations if the user is present and automatically prevents fire hazards from overheating conditions if the user is not present.

Cooking is an art and the creative procedures involved are as varied as the resulting delicacies. A safety device should be transparent to the users and not limiting, interfering or complicating the creative cooking processes. This invention will not alter nor interfere with any normal cooking process and is specifically designed to address the fire dangers surrounding overheating conditions in unattended or forgotten cooking.

This safety device operates using a motion detector and a temperature sensitive operating switch that can be incorporated by manufacturers directly into a new burner apparatus without changing its appearance or operating procedures. This device can also be retrofitted to existing burners with minimum disassembling. Common infrared heat sensing type motion detectors with limited view angles can be placed inside a stove or mounted somewhere nearby overlooking the stove area.

Home cooking with stove-top burners can generally be categorized into two common forms, frying and boiling. The frying process includes either pan-frying with a small amount of oil or deep-frying, where food is immersed in hot oil. During frying, a cooking utensil may be maintained at a temperature well above the water boiling point of 212° F. (100° C.). Despite the high heat involved, the frying process, however, poses very low risks for fire because it is always carried out under close supervision. Therefore no additional safety measure other than an exercise of common sense is required when a burner is operated in such a manner. The risks for fire, however, are considerably higher for the second type of stove-top cooking processes, boiling or steaming, i.e., cooking with water-based liquid. Because the boiling or steaming process usually takes longer to complete and does not require as much supervision, users are less attentive. Kitchen fires are often the result of such inattentiveness and occur mostly during the process of boiling or steaming of food.

Cooking food by boiling or steaming poses a much greater risk for fire than frying as the process often is left unattended or even forgotten. This proposed safety device is set to eliminate or drastically reduce such risks involved by activating a temperature sensor switch that automatically shuts off power to the burner under overheating conditions. All boiling cooking utilizes water-based liquids. When there is liquid in a utensil, the temperatures of the liquid as well as that at the center of the bottom of the utensil will rise initially and then be held fairly constant at or below the boiling point of water. This is because much of the heat from the burner is being absorbed by the liquid and utilized in the vaporization process. Therefore, as long as there is liquid in the utensil, heat is mainly diffused through evaporation of the liquid and the temperature at the utensil bottom will stay below the boiling point of the liquid.

Here, a mechanism is used by means of a temperature sensor switch which consists of three components, a temperature sensor, a power shut-off switch and the controlling link between the two, and is installed directly under the burner, extending through the center of the burner and away from direct contact of coil element 1 or gas flame (FIG. 1). The temperature sensor 2, located in the center of the burner and being held in close contact with the underside of a cooking utensil by means of a slightly compressed spring 3, measures the temperature of the utensil bottom. The utensil bottom temperature will not rise above the boiling point of water during boiling or steaming for as long as there is water-based liquid in the utensil. However, as soon as all the liquid in the cooking utensil is evaporated, the temperature will begin to rise rapidly. When this rising temperature crosses a predetermined threshold range (nominally set about 250° F.–270° F., or 120° C.–130° C.) the sensor triggers a power shut-off switch 4 which then will shut off either the electric power or the gas supply to the burner as the case may be. Once the power has been shut off the burner is inoperable until the switch is reset manually. The design of such a temperature sensor switch may incorporate one of many kinds of temperature sensors such as thernistor, bimetal, ceramic magnet, or thermocouple (U.S. Pat. No. 2,813,962 and others). Likewise, the controlling link can be by several different modes, i.e., mechanical, acoustic or electromagnetic. The power shut-off switch itself could be a simple contact point for electric burners or a solenoid valve for gas burners.

A temperature sensor switch that senses the cooking utensil temperature and positively shuts off power to a burner when a preset temperature threshold is reached can serve as a safety device in situations such as the one just described. However, to use it in all cooking situations would require a switch that has a variable temperature threshold and the selection of a suitable threshold point each time before use according to the type of cooking. For example a switch with a threshold point of 250°F. (~120° C.) is suitable for safeguarding boiling or steaming but is not suitable for frying; the higher heat involved with the frying process would trigger the safety switch prematurely, interrupting an otherwise normal cooking process. Other approaches to utilize just a temperature sensor switch as a safety device would demand the designation of only certain burner(s) with the device installed on a stove-top to be used for boiling and others for frying or the use of a bypass switch to turn the safety device on and off. Regardless, any requirements for additional user input before the use of a burner would diminish the usefulness of a fire safety device, particularly when fire risks are significantly higher in unattended or forgotten cooking situations.

Therefore, it is the purpose of this invention to improve the conventional stove-top burner with an automated, active fire safeguard device. The device will perform non-intrusively and only as necessary, such as during the user's absence. Otherwise, the power shut-off mechanism of the device will be deactivated so that the burner will function as if no safety device is attached. The deactivation is achieved, for example, with a solenoid energized by a motion detector to draw a switch that blocks the power shut-off mechanism. A nominal delay time (about 3–5 minutes) is allowed before the reactivation of the power shut-off mechanism to give the user freedom to move about. The normal temperature sensing and power shut-off sequence of the safety device will be restored if no user presence is detected and the delay time has expired. This condition that no user presence is detected and that the delay time has expired shall be referred to as condition A. The integration of a motion detector in the proposed safety device makes the device transparent to users and thus suitable to be incorporated into all burner units. The motion detector can have a variable placement location and peripheral view to detect the presence of a user in a predetermined proximity of the burner and can employ different types of sensing mechanism such as infrared, ultrasound, optical, or weight-sensing switches.

FIG. 2 describes the logical concept of this invention. After a burner has been turned on, a motion detector continuously monitors the presence of a user near the burner. If a user presence is detected, the temperature sensor switch of the safety device is bypassed and power flows uninterrupted. The switch will also be bypassed if no user is present and the time since the last user presence is less than a preset delay time. The delay time is reset each time a user presence is detected. However, if no user presence is detected and the delay time has elapsed, the temperature sensor switch will then be activated to monitor any overheating conditions. It will trigger a power shut-off switch whenever an overheating condition is encountered.

The following describes the functioning of a safety device incorporating a ceramic magnet temperature sensor. Ceramic magnet temperature sensors are very simple and reliable. They are used in millions of household automatic rice cookers. Each sensor consists of two magnets of which one or two are of the ceramic type. The safety device is built into a electric burner unit operating under condition A. The sensor 2, enclosed in cylindrical housing and shield, is positioned in the center of the burner coil element 1 and is spring-loaded to stay in close contact with the bottom of a cooking utensil as illustrated in FIG. 1. One of the magnets, a ceramic magnet 5 is attached to the underside of the metal cap 9 of the housing and senses the temperature of the bottom of the cooking utensil through the cap. The other magnet 6 is attached to a base 10 which by means of a mechanical arm 11 links and controls a power shut-off switch, represented by the contact point switch 4. Also connected to the base is a spring 12 which becomes compressed when the two magnets are united. The Curie point which defines the temperature that a magnet would rapidly lose its magnetic property is designed to be about 120° C. for the ceramic magnet. The Curie point for the other magnet can either be the same or higher. The two magnets are normally united together by their attractive forces which in turn keep the contact point switch in the closed or "on" position, permitting full range of cooking. The switch also is kept closed in situations other than condition A by a solenoid actuated arm. The solenoid is energized by a motion detector which is integrated into the proposed device. When the temperature of the magnets rises beyond the ceramic magnet Curie point, as in the case when the liquid in the cooking utensil becomes substantially vaporized, the magnets will no longer be attracted to each other and the forces of the compressed spring and gravity will separate the two magnets which will then push the mechanical arm 11 down to trip the contact point switch 4 open. This process puts the switch in the "off" position, disconnecting the flow of electricity to the burner. Trials have shown this to occur within 20 seconds after the liquid in the utensil has evaporated regardless of the shape, size or construction materials of the utensil. Unlike a temperature regulating device which cycles burner power on and off the proposed safety device when tripped will positively shut off power to the burner and renders both the burner and the motion detector inoperative until the switch is manually reset. This resetting can be accomplished, after the overheating condition has been corrected, by a separate momentary contact type switch that briefly energizes the same solenoid to bring the power shut-off switch back to the closed or "on" position.

The scenarios for safety devices incorporating other types of temperature sensor switches are similar. For example, a bimetal thermostat with a proper set point and electric load rating can be modified to function not as a temperature regulating device but as a temperature sensor switch that positively shuts off power when a preset temperature threshold range (for example, 250° F.–270° F., or 120° C.–130° C.) is reached. A simple metal bar with known heat expansion coefficient can serve both as the temperature sensor and the link that controls the power shut-off switch. The length of the metal bar will expand with rising temperature and when a certain length is reached, corresponding to the preset threshold temperature range, it triggers the power shut-off switch to stop the cooking process.

FIG. 3 shows a block circuit diagram of an electric burner with a fire safety device incorporating a bimetal thermostat as a temperature sensor. The thermostat senses a temperature of a utensil placed on the burner and is normally open when the temperature is below a preset threshold, allowing uninterrupted power flow. The temperature sensor circuitry is governed by a motion detector with a delay timer. When a user presence is detected or when the period of user absence is less than a preset time of the delay timer the temperature sensor circuitry is made open by a relay triggered by the motion detector, rendering the temperature sensor circuitry inoperative regardless of the state of the thermostat. However, when no user presence is detected and the delay time has expired the circuitry is automatically activated and will trigger open a power shut-off switch whenever the preset threshold of the thermostat is reached. The power shut-off switch will require a manual reset to return it to a normally closed position.

Because the temperature sensor switch is spring loaded to ensure good contact with a utensil bottom a load sensing switch with a built in timer can incorporated into a temperature sensor switch for a fire safety device and be utilized to detect the presence of a utensil on a burner. If within a set time after the burner has been turned on and no utensil is detected the load sensing switch will shut off power to the burner. Even without such a load sensing switch the proposed fire safety device will also provide a fire safety measure when there is no utensil placed on the burner but the burner has been left on by accident. With no utensil or water-based liquid to absorb the heat, the air temperature above the burner unit will continually rise. Eventually, the threshold temperature range will be reached to initiate the power shut off sequence. Trials have shown this to occur within 10 minutes from the moment the burner was turned on. At this point, the safety device will operate identically as if a utensil were present and the power shut-off switch will be tripped to cut the flow of electricity or gas to the burner thus shutting it "off". In this case and others discussed earlier, after the power shut-off switch has been tripped the regular burner power adjusting dial still indicates that the burner is technically "on" but there will be no flow of electricity to the burner. The scenario for gas stove-tops is similar. Instead of turning off electrical power to the heating unit, the power shut-off switch in a gas burner when tripped will activate a solenoid valve to shut off the gas supply.

We claim:

1. An automated fire safety device for a gas or electric stove-top burner utilizes a motion detector governed temperature sensor switch to reduce fire risks in unattended cooking, said motion detector having a built-in timer deactivates the said temperature sensor switch when a user is present or if the period since user motion has last been detected is within a preset time to allow a user a full control of burner operation and resumes sensor switch functions when there is no user present and the said preset time has expired, said temperature sensor switch having a temperature sensor, a power shut-off switch, a linking or controlling mechanism between the sensor and the shut-off switch and an optional load-sensing switch, operable to measure a temperature of a utensil placed on the said burner and to positively shut off power to said burner when the following condition, referred to as condition B is met: there is no user present, the preset time on the said motion detector timer has expired and the temperature measured by the said temperature sensor has reached a preset level indicating an overheating condition.

2. The temperature sensor switch of claim 1 wherein said temperature sensor is variable to incorporate different types of sensors such as bimetal, thermistor, ceramic magnet or thermocouple.

3. The temperature sensor switch of claim 1 wherein said control link between the said temperature sensor and the said power shut-off switch is mechanical, acoustical or electromagnetic to transmit a signal to said power shut-off switch when the said condition B is encountered and to cause it to shut off electricity or gas flow to the said burner depending on the burner type, rendering it inoperable.

4. The motion detector of claim 1 wherein said motion detector with a variable placement location and peripheral view employs different sensing means such as infrared, ultrasound, optical, or weight-sensing switches to detect the presence of a user in a predetermined proximity of the said burner unit.

5. The temperature sensor switch of claim 1 wherein a load-sensing switch is optionally incorporated to sense whether a utensil is on a burner and to shut off burner power if no utensil is detected for a predetermined time, the load-sensing switch is in the form mechanical, acoustical or electromagnetic means.

* * * * *